US009770919B2

(12) United States Patent
Washio et al.

(10) Patent No.: US 9,770,919 B2
(45) Date of Patent: Sep. 26, 2017

(54) RECORDING APPARATUS

(71) Applicant: SEIKO EPSON CORPORATION, Tokyo (JP)

(72) Inventors: Yuichi Washio, Matsumoto (JP); Kentaro Miyazaki, Matsumoto (JP); Kazuaki Sakurada, Suwa (JP); Satoru Katagami, Matsumoto (JP); Kazuya Tajima, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/022,171

(22) PCT Filed: Nov. 26, 2014

(86) PCT No.: PCT/JP2014/005901
§ 371 (c)(1),
(2) Date: Mar. 15, 2016

(87) PCT Pub. No.: WO2015/079680
PCT Pub. Date: Jun. 4, 2015

(65) Prior Publication Data

US 2016/0221366 A1 Aug. 4, 2016

(30) Foreign Application Priority Data

Nov. 27, 2013 (JP) ..... 2013-244826

(51) Int. Cl.
*B41J 11/00* (2006.01)
*B41J 2/175* (2006.01)
(Continued)

(52) U.S. Cl.
CPC ..... *B41J 11/0015* (2013.01); *B41J 2/155* (2013.01); *B41J 2/17596* (2013.01); *B41J 2/2114* (2013.01)

(58) Field of Classification Search
CPC .. B41J 11/0015; B41J 2/2114; B41J 2/17596; B41J 2/155
See application file for complete search history.

(56) References Cited

U.S. PATENT DOCUMENTS 6,398,357 B1 6/2002 Holloway et al.
7,530,684 B2 * 5/2009 Yamanobe ..... B41J 2/2114 347/100
(Continued)

FOREIGN PATENT DOCUMENTS

CN 101396910 B 4/2009
CN 102 177 024 9/2011
(Continued)

OTHER PUBLICATIONS

PCT/JP2014/005901, International Search Report dated Jan. 27, 2015 (08 pages).
(Continued)

*Primary Examiner* — Geoffrey Mruk
(74) *Attorney, Agent, or Firm* — Workman Nydegger

(57) ABSTRACT

There is provided a recording apparatus in which it is possible to use a suitable reaction liquid to be applied on the recording medium, out of multiple types of reaction liquids. A recording apparatus includes a transport mechanism that transports a recording medium, a reaction liquid applying mechanism that selectively applies, on the recording medium, either a first reaction liquid that reacts with ink or a second reaction liquid that reacts with the ink and is different from the first reaction liquid, and an ink discharge mechanism that is positioned downstream from the reaction liquid applying mechanism in the transport direction of the recording medium and discharges the ink onto the recording medium. It is preferable that the reaction liquid applying mechanism include a first reaction liquid discharge unit that
(Continued)

discharges the first reaction liquid and a second reaction liquid discharge unit that discharges the second reaction liquid.

8 Claims, 5 Drawing Sheets

(51) Int. Cl.
*B41J 2/155* (2006.01)
*B41J 2/21* (2006.01)

(56) References Cited

U.S. PATENT DOCUMENTS

| | | | |
|---|---|---|---|
| 2006/0214966 | A1 | 9/2006 | Tatsumi |
| 2007/0013759 | A1 | 1/2007 | Kadomatsu et al. |
| 2007/0024684 | A1 | 2/2007 | Konno et al. |
| 2007/0064026 | A1 | 3/2007 | Hirakawa |
| 2009/0072888 | A1 | 3/2009 | Ogata |
| 2009/0237425 | A1 | 9/2009 | Lang |
| 2011/0102076 | A1 | 5/2011 | Ogata |
| 2011/0193919 | A1 | 8/2011 | Chung et al. |
| 2012/0256683 | A1 | 10/2012 | Ogata |
| 2013/0300788 | A1 | 11/2013 | Konno et al. |
| 2014/0232448 | A1 | 8/2014 | Ogata |
| 2015/0194955 | A1 | 7/2015 | Ogata |
| 2016/0156349 | A1 | 6/2016 | Ogata |

FOREIGN PATENT DOCUMENTS

| | | | |
|---|---|---|---|
| JP | 2007-106117 | A | 4/2007 |
| JP | 2010-099968 | | 5/2010 |
| JP | 2012-505094 | A | 3/2012 |
| JP | 2013-042264 | | 4/2013 |
| TW | 577829 | | 10/2001 |

OTHER PUBLICATIONS

European Search Report for Application No. 14866322.2 dated Jan. 2, 2017.

* cited by examiner

[Fig. 1]
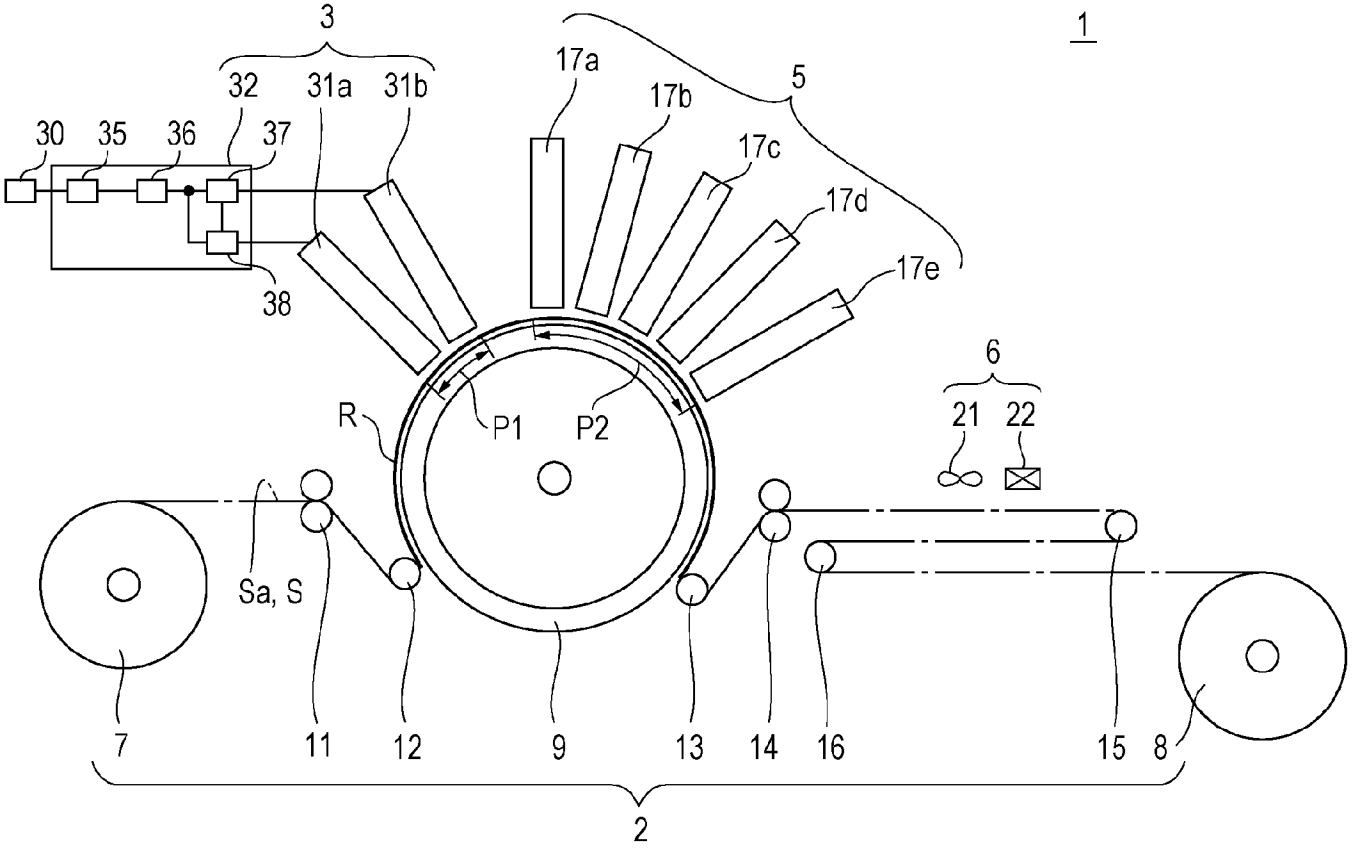

[Fig. 2]
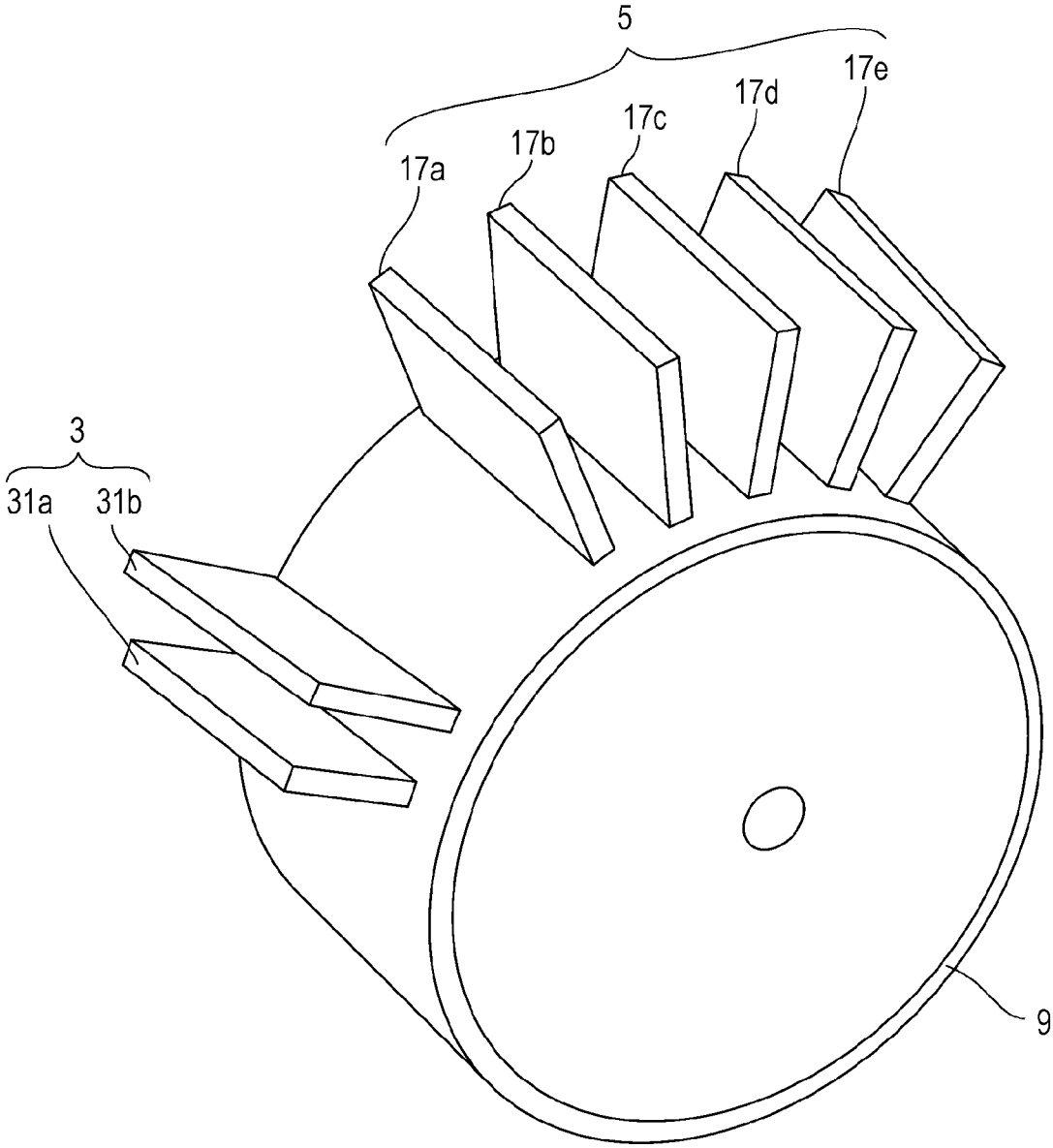

[Fig. 3]
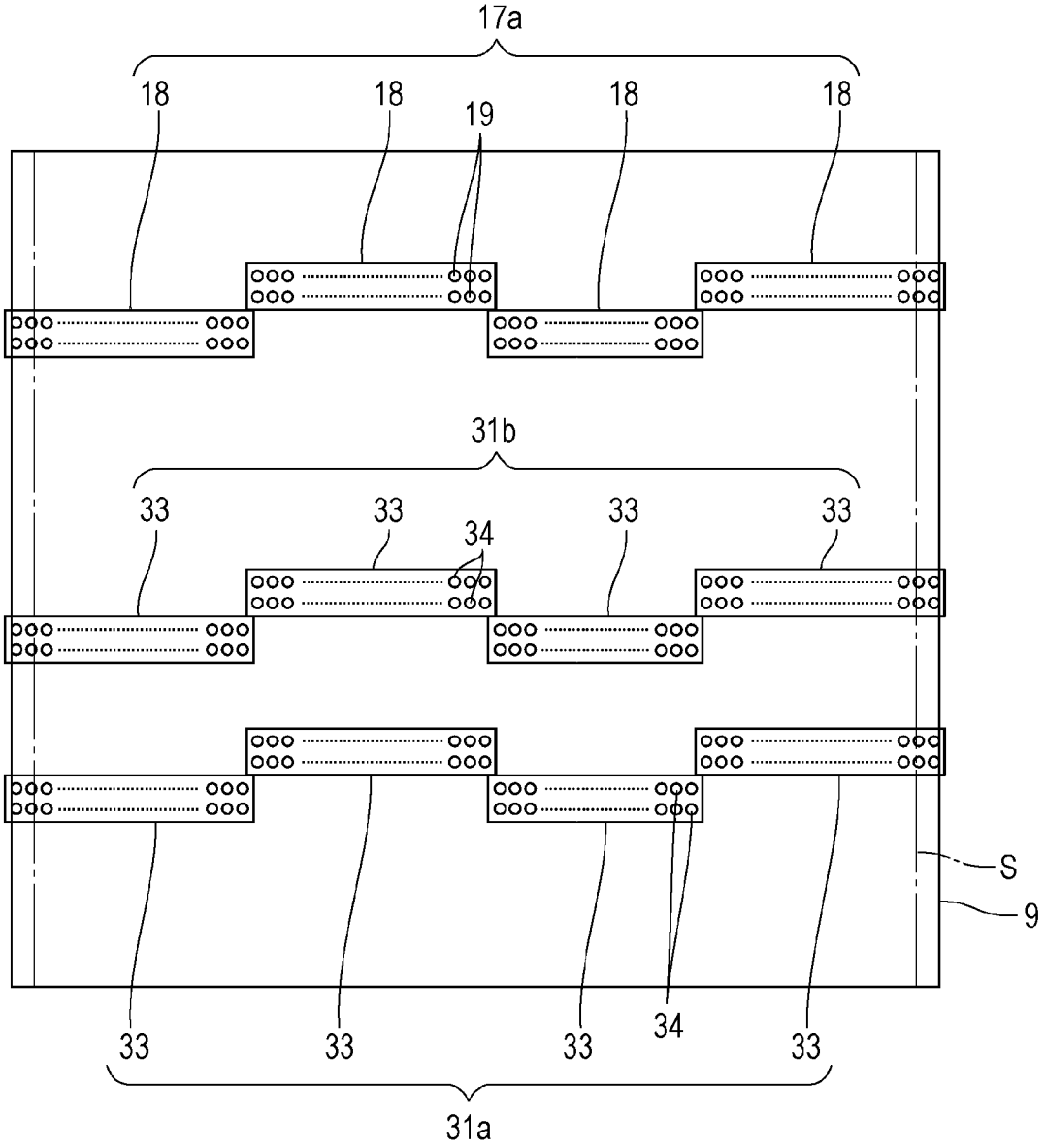

[Fig. 4]
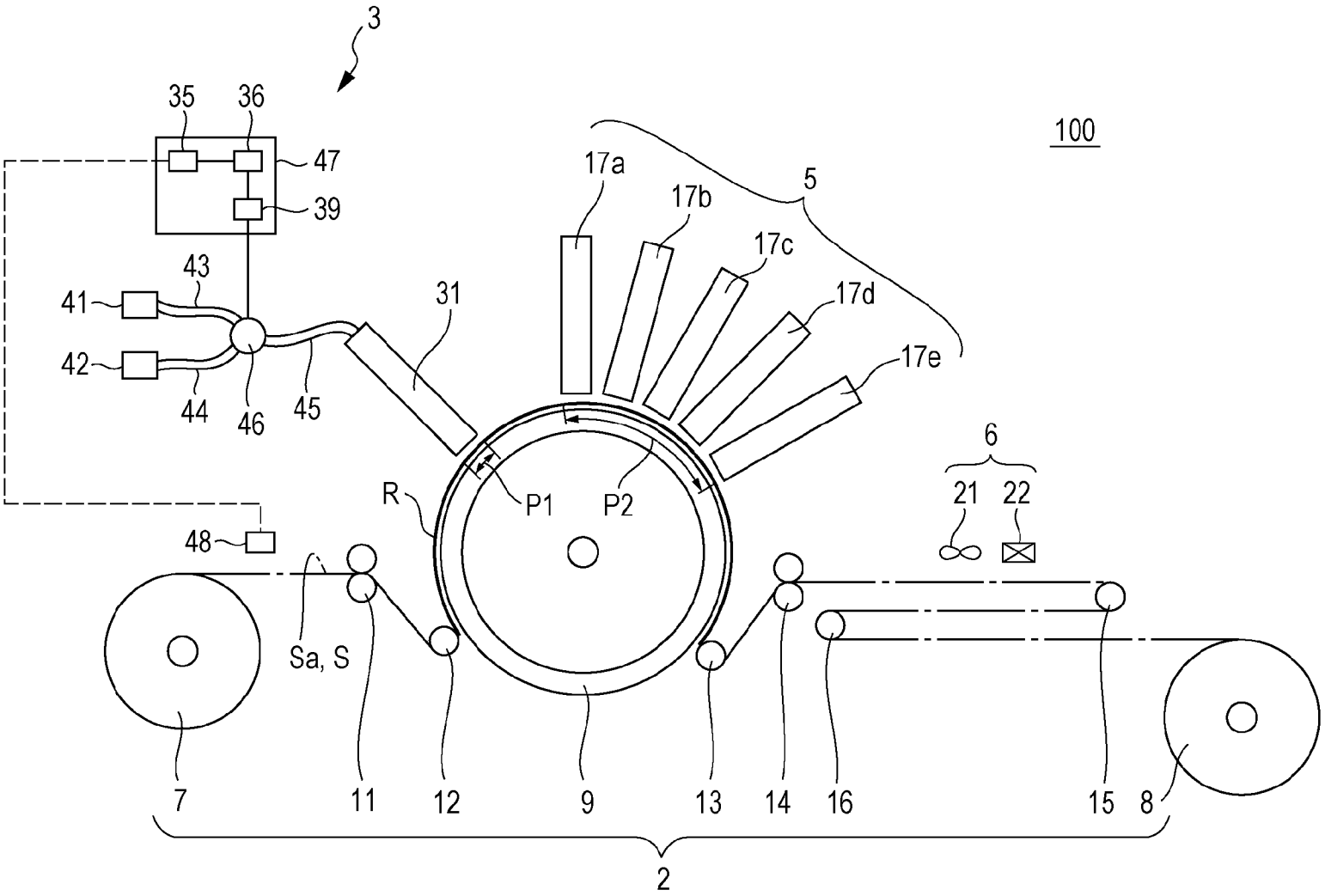

[Fig. 5]
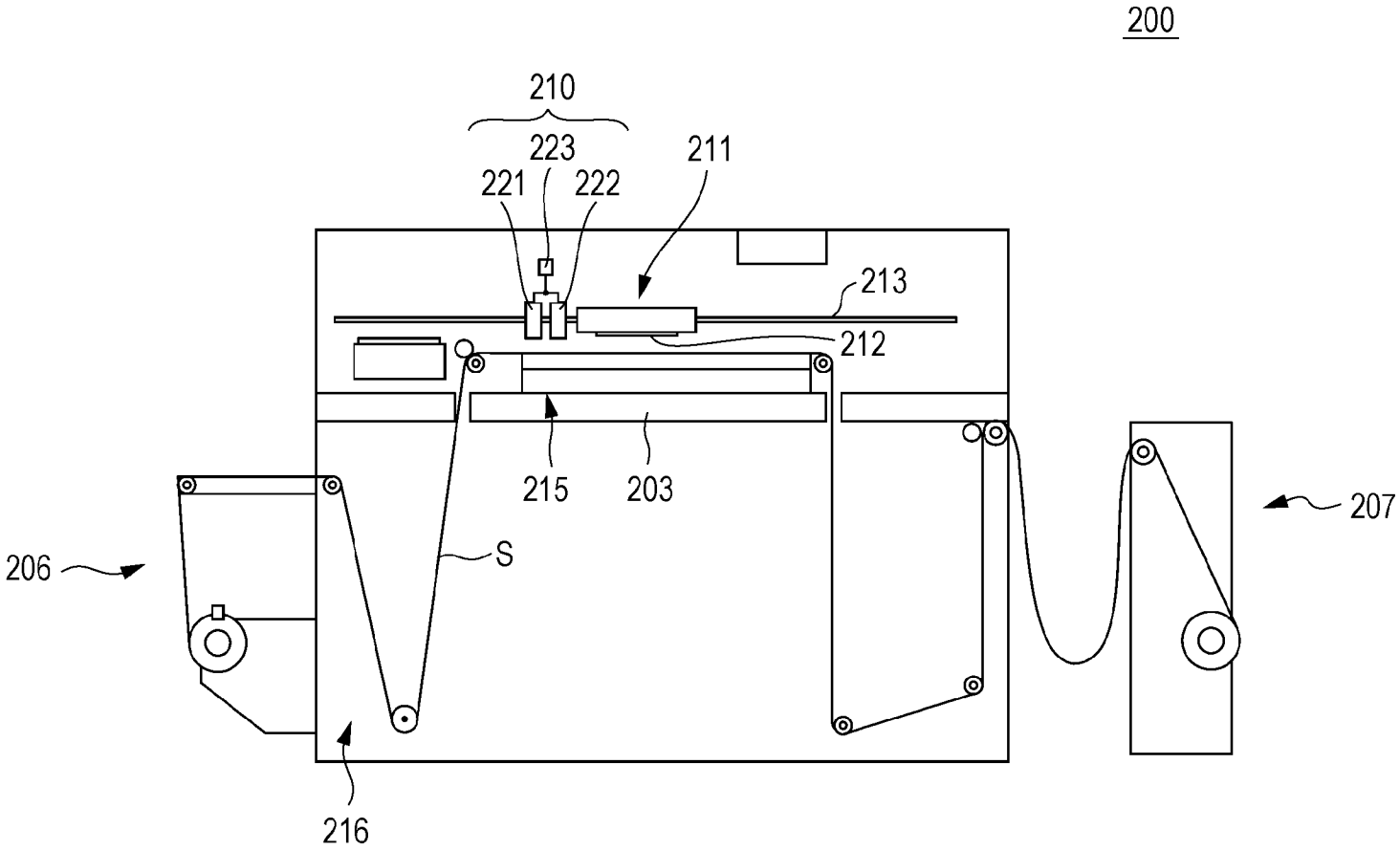

RECORDING APPARATUS

TECHNICAL FIELD

The present invention relates to a recording apparatus in which ink is discharged onto a recording medium and recording is performed.

BACKGROUND ART

In the related art, an ink jet recording apparatus that includes a process liquid applying unit which applies a process liquid onto coated paper for printing, and an ink dropping unit which drops droplets of ink that coagulates with the process liquid, onto the coated paper for printing, is known. Examples of a coagulant contained in the process liquid include phosphoric acid, oxalic acid, malonic acid, or the like (see PTL 1).

CITATION LIST

Patent Literature

PTL 1: JP-A-2010-099968

SUMMARY OF INVENTION

Technical Problem

In the ink jet recording apparatus of the related art, the coated paper for printing is used as the only target of the recording medium. Therefore, in the ink jet recording apparatus of the related art, it is not considered to use a suitable reaction liquid to be applied on the recording medium, out of multiple types of reaction liquids.

Accordingly, it is an object of the present invention to provide a recording apparatus in which it is possible to use a suitable reaction liquid to be applied on the recording medium, out of multiple types of reaction liquids.

Solution to Problem

According to the invention, there is provided a recording apparatus including: a transport mechanism that transports a recording medium; a reaction liquid applying mechanism that selectively applies, on the recording medium, either a first reaction liquid that reacts with ink or a second reaction liquid that reacts with the ink and is different from the first reaction liquid; and an ink discharge mechanism that is positioned downstream from the reaction liquid applying mechanism in the transport direction of the recording medium and discharges the ink onto the recording medium.

According to the invention, there is provided a recording method including: selectively applying, on a recording medium, either a first reaction liquid that reacts with ink or a second reaction liquid that reacts with the ink and is different from the first reaction liquid; and discharging the ink onto the recording medium with either the first reaction liquid or the second reaction liquid applied.

In this configuration, when recording is performed on a first recording medium for which the first reaction liquid is suitable, the reaction liquid applying mechanism can apply the first reaction liquid on the first recording medium. On the other hand, when recording is performed on a second recording medium for which the second reaction liquid is suitable, the reaction liquid applying mechanism can apply the second reaction liquid on the second recording medium.

Accordingly, it is possible to use a suitable reaction liquid to be applied on the recording medium out of multiple types of reaction liquids.

In the recording apparatus, it is preferable that the reaction liquid applying mechanism include a reaction liquid discharge section that selectively discharges either the first reaction liquid or the second reaction liquid, onto a certain position of the recording medium.

In this configuration, the reaction liquid discharge section selectively applies either the first reaction liquid or the second reaction liquid, and thus it is possible to suitably apply either the first reaction liquid or the second reaction liquid onto a certain position of the recording medium.

In this case, it is preferable that the reaction liquid discharge section include a first reaction liquid discharge unit that discharges the first reaction liquid and a second reaction liquid discharge unit that discharges the second reaction liquid.

In this configuration, the first reaction liquid discharge unit discharges the first reaction liquid onto the recording medium. In addition, the second reaction liquid discharge unit discharges the second reaction liquid onto the recording medium. Accordingly, it is possible to selectively apply either the first reaction liquid or the second reaction liquid on the recording medium.

In this case, it is preferable that the reaction liquid applying mechanism further include a first reaction liquid container in which the first reaction liquid is contained, a second reaction liquid container in which the second reaction liquid is contained, and a switching unit that performs switching between a first state, where the first reaction liquid is supplied from the first reaction liquid container to the reaction liquid discharge section, and a second state, where the second reaction liquid is supplied from the second reaction liquid container to the reaction liquid discharge section.

In this configuration, when the switching unit switches to the first state, the first reaction liquid is supplied to the reaction liquid discharge section, and the reaction liquid discharge section discharges the first reaction liquid onto the recording medium. In addition, when the switching unit switches to the second state, the second reaction liquid is supplied to the reaction liquid discharge section, and the reaction liquid discharge section discharges the second reaction liquid onto the recording medium. Accordingly, it is possible to selectively apply either the first reaction liquid or the second reaction liquid on the recording medium.

In this case, it is preferable that the first and second reaction liquids each contain a coagulant to react with the ink, thereby promoting fixing of the ink on the recording medium.

In this configuration, it is possible to promote the fixing of the ink on the recording medium.

In this case, it is preferable that the recording apparatus further include an input unit to which the type of recording medium is input, in which the reaction liquid applying mechanism selectively applies either the first reaction liquid or the second reaction liquid, on the basis of a result of input to the input unit.

In this configuration, it is possible to suitably use either the first reaction liquid or the second reaction liquid on the basis of the type of recording medium.

In this case, it is preferable that the type of recording medium be input to the input unit by an operator.

In this configuration, it is possible to suitably use either the first reaction liquid or the second reaction liquid, in accordance with the type of recording medium input by the operator.

In this case, it is preferable that the recording apparatus further include a detection unit that detects the type of recording medium, in which the type of recording medium detected by the detection unit is input to the input unit.

In this configuration, it is possible to suitably use either the first reaction liquid or the second reaction liquid, in accordance with the type of recording medium detected by the detection unit.

According to the invention, there is provided another recording method in which a reaction liquid to react with ink is applied on a recording medium, then the ink is discharged onto the recording medium, and recording is performed, the recording method including: applying a first reaction liquid on a first recording medium having a first permeability; and applying a second reaction liquid that is different from the first reaction liquid on a second recording medium having a second permeability which is different from the first permeability.

In this configuration, it is possible to suitably use either the first reaction liquid or the second reaction liquid, in accordance with the permeability of the recording medium.

BRIEF DESCRIPTION OF DRAWINGS

FIG. 1 is a view illustrating a configuration of a recording apparatus according to a first embodiment of the invention.

FIG. 2 is a perspective view illustrating a periphery of a rotating drum in the recording apparatus.

FIG. 3 is a view illustrating a head unit and reaction liquid discharge units in the recording apparatus.

FIG. 4 is a view illustrating a configuration of a recording apparatus according to a second embodiment of the invention.

FIG. 5 is a view illustrating a configuration of a recording apparatus according to a third embodiment of the invention.

DESCRIPTION OF EMBODIMENTS

Hereinafter, a recording apparatus according to a first embodiment of the invention will be described with reference to the accompanying drawings. In the recording apparatus according to the embodiment, a reaction liquid to react with ink is discharged onto a long recording medium, such as a label sheet, onto which the ink is discharged, and recording is performed. It is possible to use a variety of materials, such as a paper-based one or a film-based one, as the recording medium. Examples of the paper-based recording medium include high-quality paper, coated paper, and cast paper. Examples of the film-based recording medium include a polypropylene (PP) film, a polyethylene terephthalate (PET) film, and a polyethylene (PE) film.

As shown in FIGS. 1 and 2, the recording apparatus 1 according to the first embodiment includes a transport mechanism 2 that transports a recording medium S, a reaction liquid applying mechanism 3 that applies the reaction liquid on the recording medium S, an ink discharge mechanism 5 that discharges ink onto the recording medium S with the reaction liquid discharged thereon, and a drying mechanism 6 that dries the recording medium S, onto which the ink is discharged.

The transport mechanism 2 transports the recording medium S in a roll-to-roll method. The transport mechanism 2 includes a supply reel 7 and a winding reel 8, a rotating drum 9 provided approximately in the middle of a transport route, and multiple rollers provided on the transport route.

The multiple rollers include an upstream-side transport roller 11, an upstream-side guide roller 12, a downstream-side guide roller 13, a downstream-side transport roller 14, and first and second turn-back rollers 15 and 16, which are provided in order from the upstream side in the transport direction. When the supply reel 7, the upstream-side transport roller 11, the downstream-side transport roller 14 and the winding reel 8 are rotationally driven, the recording medium S is supplied from the supply reel 7 and is transported along the circumferential surface of the rotating drum 9 in the transport direction, and then is wound around the winding reel 8. The first and second turn-back rollers 15 and 16 are provided in the drying mechanism 6.

The rotating drum 9 is a cylindrical drum rotatably supported using a support mechanism not shown. A rear surface side, that is, an opposite side to a recording surface Sa, of the recording medium S is supported on the outer circumferential surface of the rotating drum 9. When the recording medium S is transported along the outer circumferential surface of the rotating drum 9, the rotating drum 9 rotates along with the movement of the recording medium due to a force of friction between the outer circumferential surface and the recording medium S.

A transport route along the outer circumferential surface of the rotating drum 9, out of the transport route of the recording medium S from the supply reel 7 to the winding reel 8, is referred to as an outer circumferential surface transport route R. In FIG. 1, the outer circumferential surface transport route R is shown in a thick solid line. The reaction liquid applying mechanism 3 discharges the reaction liquid onto the recording medium S at a first position P1 on the outer circumferential surface transport route R. The ink discharge mechanism 5 discharges the ink onto the recording medium S at a second position P2 that is downstream from the first position P1 in the transport direction, in the outer circumferential surface transport route R.

The ink discharge mechanism 5 includes a first head unit 17*a*, a second head unit 17*b*, a third head unit 17*c*, a fourth head unit 17*d*, and a fifth head unit 17*e*, which are provided in order from the upstream side in the transport direction. The head units 17*a* to 17*e* are radially arranged on the periphery of the rotating drum 9.

As shown in FIG. 3, the head units 17 are each provided with four ink discharge heads 18, for example. Each ink discharge head 18 discharges the ink in an ink jet method, and has multiple ink discharge nozzles 19. The ink discharge nozzles 19 of the four ink discharge heads 18 are arranged corresponding to the width of the rotating drum 9. That is, the head units 17 are line-type head units. Accordingly, unlike a serial-type head unit, the head units 17 can discharge the ink across the entire width of the recording medium S, without scanning the recording medium S in the width direction.

In the embodiment, the four ink discharge heads 18 are aligned and constitute a single head unit 17. However, when the ink discharge heads are aligned in a straight line in the width direction of the recording medium S, in some cases, a pitch between nozzles extends on a joint portion. Therefore, the ink discharge heads are shifted in the transport direction of the recording medium S. The amount of the shift can be compensated for by shifting a discharge timing of the ink discharge head 18. Accordingly, the method, in which the multiple ink discharge heads 18 are aligned and constitute a single head unit 17, has an advantage in that a production cost is low. Meanwhile, when a single ink discharge head 18 constitutes the head unit 17, there is a possibility that the cost is increased. However, it is advantageous that there is no need to shift the discharge timing of the ink discharge head 18.

The first head unit 17*a* discharges white ink. The second head unit 17*b* discharges black ink. The third head unit 17*c* discharges yellow ink. The fourth head unit 17*d* discharges cyan ink. The fifth head unit 17*e* discharges magenta ink. For example, when the recording medium S is made of a transparent film material, the white ink is discharged onto the entire surface by the first head unit 17*a* such that a white base is formed, each color ink is discharged onto the formed white base by the second to fifth head units 17*b* to 17*e*, and a color image is formed. In addition, when the recording medium S is made of a paper material, without discharging the white ink onto the entire surface by the first head unit 17*a*, each color ink may be discharged by the second to fifth head units 17*b* to 17*e*, and a color image may be formed.

It is needless to say that the colors of the ink to be discharged by the head units 17 are not particularly limited. The number of head units 17, that is, the number of colors of ink to be discharged by the ink discharge mechanism 5, is not particularly limited.

The ink to be discharged by the head units 17 is not particularly limited, as long as the ink reacts with the reaction liquid applied by the reaction liquid applying mechanism 3. However, it is preferable that the ink have a coloring material dispersed in a solvent. For example, a pigment ink in which a pigment is used as a coloring material can be appropriately used as the ink having a coloring material dispersed in a solvent.

The drying mechanism 6 is provided between the rotating drum 9 and the winding reel 8. The drying mechanism 6 includes a drying fan 21 and a drying heater 22, and blows hot air onto the recording medium S with the reaction liquid and the ink discharged thereon such that the hot air moves approximately in parallel with the recording surface Sa, thereby drying the recording medium S. At the drying mechanism 6, the transport route of the recording medium S is turned back by the first and second turn-back rollers 15 and 16. Therefore, the hot air can efficiently reach the recording medium S, without providing the drying mechanism 6 with a wide space.

The drying mechanism 6 may dry the recording medium S by blowing room-temperature airflow, using the drying fan 21 alone, or may dry the recording medium S by heating the recording medium S, using the drying heater 22 alone.

The reaction liquid applying mechanism 3 includes a first reaction liquid discharge unit 31*a* that discharges a first reaction liquid, a second reaction liquid discharge unit 31*b* that discharges a second reaction liquid, and a discharge drive section 32 that selectively drives either the first reaction liquid discharge unit 31*a* or the second reaction liquid discharge unit 31*b*.

The discharge drive section 32 is an example of "selection drive section" in the claims of the invention.

As shown in FIG. 3, the reaction liquid discharge units 31 are each provided with four reaction liquid discharge heads 33, for example. Each reaction liquid discharge head 33 discharges the reaction liquid in an ink jet method, and has multiple reaction liquid discharge nozzles 34. The reaction liquid discharge nozzles 34 of the four reaction liquid discharge heads 33 are arranged corresponding to the width of the rotating drum 9. That is, the reaction liquid discharge units 31 are line-type discharge units. Accordingly, unlike a serial-type discharge unit, the reaction liquid discharge units 31 can discharge the reaction liquid onto the entire width of the recording medium S, without scanning the recording medium S in the width direction.

The reaction liquid discharge units 31 may discharge the reaction liquid onto the entire surface of the recording medium S, or may discharge the reaction liquid only onto a region where the ink is discharged by the ink discharge mechanism 5. The reaction liquid discharge heads 33 used in the reaction liquid discharge unit 31 can use the same components as the ink discharge heads 18.

As long as the reaction liquid reacts with the ink to be discharged by the head units 17, the reaction liquid is not particularly limited. When the ink having a coloring material dispersed in a solvent is used, it is preferable that the reaction liquid be used, in which a coagulant to coagulate the coloring material is dissolved in the solvent. In this case, when the ink is discharged onto the recording medium S with the reaction liquid discharged thereon, Coulomb repulsion between coloring material particles in the ink is neutralized by the coagulant in the reaction liquid, and the coloring materials coagulates with each other. Accordingly, the ink discharged onto the recording medium S has an increased viscosity, and the fixability of the ink onto the recording medium S is increased.

The reaction between the reaction liquid and the ink is not limited to the coagulation of the coloring material by the coagulant as described above.

As the solvent of the reaction liquid, water is preferable, or a water-soluble organic solvent, such as polyhydric alcohols, polyhydric alcohol derivatives, or the like, may be added to water.

As the coagulant, metal salts are preferable, and among the metal salts, multivalent metal salts are preferable in terms of a coagulation force. As the multivalent metal salt, it is possible to suitably use one or a plurality selected from calcium nitrate, calcium chloride, magnesium chloride, calcium acetate, magnesium acetate, and calcium formate.

Of those coagulants, calcium nitrate, calcium chloride, and magnesium chloride are deliquescent and odorless. Meanwhile, calcium acetate, magnesium acetate, and calcium formate are non-deliquescent and have a pungent odor.

When the coagulant has a pungent odor, reaction of the coagulant with the ink on the recording medium S causes the pungent odor to disappear. However, when some coagulant that has not reacted with the ink remains on the recording medium S, the pungent odor derived from the coagulant remains on the recording medium S, even after the completion of the recording. In a case of the recording medium S with a low permeability, the reaction liquid does not permeate into the recording medium S, but reacts with the ink on the recording medium S. Therefore, the pungent odor does not remain on the recording medium S after the completion of the recording. In contrast, in a case of the recording medium S with a high permeability, the reaction liquid permeates into the recording medium S in the thickness direction, and the coagulant that has not reacted with the ink remains in the recording medium S. Therefore, when the coagulant has the pungent odor, a problem can arise in a case where recording is performed on the recording medium S with a high permeability.

Meanwhile, when the coagulant is deliquescent, the coagulant attached to the recording medium S takes in moisture in air, even after the completion of the recording. In a case of the recording medium S with a high permeability, the moisture taken in by the coagulant is absorbed into the recording medium S. In contrast, in a case of the recording medium S with a low permeability, the moisture taken in by the coagulant is not absorbed into the recording medium S. Therefore, the ink does not dry, and thus the ink is easily detached. Accordingly, when the coagulant is deliquescent, a problem can arise when recording is performed on the recording medium S with a low permeability.

When the recording medium S is paper-based medium with a high permeability, it is preferable that the coagulant be odorless. Accordingly, it is possible to use one or a plurality selected from calcium nitrate, calcium chloride, and magnesium chloride.

Meanwhile, when the recording medium S is film-based medium with a low permeability, it is preferable that the coagulant be non-deliquescent. Accordingly, it is possible to use one or a plurality selected from calcium acetate, magnesium acetate, and calcium formate.

In the following description, the first reaction liquid discharged by the first reaction liquid discharge unit 31*a* contains calcium nitrate as the coagulant, and the second reaction liquid discharged by the second reaction liquid discharge unit 31*b* contains calcium acetate as the coagulant.

The discharge drive section 32 includes an operation unit 30, an input unit 35, a control circuit 36, a first driver 37, and a second driver 38.

The operation unit 30 is used when an operator inputs a type of recording medium S set on the transport mechanism 2. The operation unit 30 is configured to have a toggle switch on which the marks of "paper-based" and "film-based" are attached.

The operation unit 30 is not limited to such a toggle switch, but may be configured to have a touch panel. The type of reaction liquid may be input instead of the type of recording medium S using the operation unit 30.

The type of recording medium S is input to the input unit 35, in accordance with a result of operation of the operation unit 30 by the operator.

The control circuit 36 selectively transmits a control signal to the first driver 37 and the second driver 38, on the basis of the type of recording medium S input to the input unit 35.

The first driver 37 drives discharge of the first reaction liquid discharge unit 31*a*, on the basis of the control signal transmitted from the control circuit 36. The second driver 38 drives discharge of the second reaction liquid discharge unit 31*b*, on the basis of the control signal transmitted from the control circuit 36.

In the reaction liquid applying mechanism 3 with such a configuration, when "paper-based" is input to the input unit 35 as the type of recording medium S in accordance with the operator's operation of the operation unit 30, the control circuit 36 transmits the control signal to the first driver 37, and the first driver 37 drives discharge of the first reaction liquid discharge unit 31*a*. Accordingly, the first reaction liquid discharge unit 31*a* discharges the first reaction liquid, that is, the reaction liquid that contains calcium nitrate as the coagulant. In this case, the second reaction liquid discharge unit 31*b* does not discharge the second reaction liquid, that is, the reaction liquid that contains calcium acetate as the coagulant.

Meanwhile, in the reaction liquid applying mechanism 3, when "film-based" is input to the input unit 35 as the type of recording medium S in accordance with the operator's operation of the operation unit 30, the control circuit 36 transmits the control signal to the second driver 38, and the second driver 38 drives discharge of the second reaction liquid discharge unit 31*b*. Accordingly, the second reaction liquid discharge unit 31*b* discharges the second reaction liquid, that is, the reaction liquid that contains calcium acetate as the coagulant. In this case, the first reaction liquid discharge unit 31*a* does not discharge the first reaction liquid, that is, the reaction liquid that contains calcium nitrate as the coagulant.

As described above, in the recording apparatus 1 according to the first embodiment, when recording is performed on the paper-based recording medium S for which the reaction liquid containing calcium nitrate is suitable, the reaction liquid containing calcium nitrate can be discharged onto the paper-based recording medium S by the first reaction liquid discharge unit 31*a*, whereas, when recording is performed on the film-based recording medium S for which the reaction liquid containing calcium acetate is suitable, the reaction liquid containing calcium acetate can be discharged onto the film-based recording medium S by the second reaction liquid discharge unit 31*b*. Accordingly, it is possible to use a suitable reaction liquid to be discharged onto the recording medium S in accordance with the type of recording medium S.

The first reaction liquid and the second reaction liquid are different from each other, but basic ingredients of the two liquids, such as the coagulants, may have a common component. For example, the first reaction liquid may contain a component A and a component B, and in some cases, the second reaction liquid may contain the component A and a component C.

Subsequently, a recording apparatus 100 according to a second embodiment will be described. The recording apparatus 100 according to the second embodiment has approximately the same configuration as the recording apparatus 1 according to the first embodiment. However, there are differences in that the recording apparatus 100 according to the second embodiment includes a detection unit 48 that detects a type of recording medium S, and the reaction liquid applying mechanism 3 includes a single reaction liquid discharge unit 31. Hereinafter, description will be provided, placing an emphasis on the differences.

As shown in FIG. 4, the recording apparatus 100 according to the second embodiment includes the detection unit 48 that is provided between the supply reel 7 and the upstream-side transport roller 11, and detects the type of recording medium S.

The detection unit 48 can be configured to have a reader that reads an identifier attached to the recording medium S. The identifier shows a type of material of the recording medium and can use a two-dimensional code in which information indicating the type of material of the recording medium S is coded. It is possible to use a two-dimensional code reader as the reader. The detection unit 48 may be configured to have a variety of sensors other than the reader.

In the recording apparatus 100 according to the second embodiment, the reaction liquid applying mechanism 3 includes the reaction liquid discharge unit 31, a first reaction liquid cartridge 41 in which the first reaction liquid is contained, and a second reaction liquid cartridge 42 where the second reaction liquid is contained. Further, the reaction liquid applying mechanism 3 includes a first reaction liquid tube 43 of which the upstream end is connected to the first reaction liquid cartridge 41, a second reaction liquid tube 44 of which the upstream end is connected to the second reaction liquid cartridge 42, a reaction liquid supply tube 45 of which the downstream end is connected to the reaction liquid discharge unit 31, a flow path switching valve 46 to which the downstream end of the first reaction liquid tube 43, the downstream end of the second reaction liquid tube 44, and the upstream end of the reaction liquid supply tube 45 are connected, and a valve control section 47 that controls the flow path switching valve 46.

The flow path switching valve 46 is an example of "switching unit" in the claims of the invention. In addition, the first reaction liquid cartridge 41 is an example of "first reaction liquid container" in the claims of the invention, and the second reaction liquid cartridge 42 is an example of "second reaction liquid container" in the claims of the invention.

The flow path switching valve 46 is configured to be switchable between a first state, where the first reaction liquid tube 43 and the reaction liquid supply tube 45 communicate with each other, and a second state, where the second reaction liquid tube 44 and the reaction liquid supply tube 45 communicate with each other. When the flow path switching valve 46 is switched to the first state, the first reaction liquid is supplied to the reaction liquid discharge unit 31 from the first reaction liquid cartridge 41. In addition, when the flow path switching valve 46 is switched to the second state, the second reaction liquid is supplied to the reaction liquid discharge unit 31 from the second reaction liquid cartridge 42.

The valve control section 47 includes the input unit 35, the control circuit 36, and a valve drive unit 39. The type of recording medium S detected by the detection unit 48 is input to the input unit 35. The control circuit 36 transmits a control signal to the valve drive unit 39, on the basis of the type of recording medium S input to the input unit 35. The valve drive unit 39 drives the flow path switching valve 46 such that the flow path switching valve 46 is switched between the first state and the second state, on the basis of the control signal from the control circuit 36.

In the reaction liquid applying mechanism 3 with such a configuration, when the detection unit 48 detects the type of recording medium S as "paper-based", the detection result is input to the input unit 35, the control circuit 36 transmits the control signal for switching the flow path switching valve 46 to the first state to the valve drive unit 39, and the valve drive unit 39 switches the flow path switching valve 46 to the first state. Accordingly, the first reaction liquid is supplied to the reaction liquid discharge unit 31 from the first reaction liquid cartridge 41, and the reaction liquid discharge unit 31 discharges the first reaction liquid, that is, the reaction liquid that contains calcium nitrate as the coagulant.

Meanwhile, in the reaction liquid applying mechanism 3, when the detection unit 48 detects the type of recording medium S as "film-based", the detection result is input to the input unit 35, the control circuit 36 transmits the control signal for switching the flow path switching valve 46 to the second state to the valve drive unit 39, and the valve drive unit 39 switches the flow path switching valve 46 to the second state. Accordingly, the second reaction liquid is supplied to the reaction liquid discharge unit 31 from the second reaction liquid cartridge 42, and the reaction liquid discharge unit 31 discharges the second reaction liquid, that is, the reaction liquid that contains calcium acetate as the coagulant. Further, according to the second embodiment, since the two types of reaction liquid pass through the single reaction liquid supply tube 45, there is a possibility that the reaction liquids may mix with each other immediately after the switching of the flow path switching valve 46. However, the above problem is solved by an operation referred to as flushing in which a small amount of reaction liquid is discharged outside a printing region.

As described above, in the recording apparatus 100 according to the second embodiment, when recording is performed on the paper-based recording medium S for which the reaction liquid containing calcium nitrate is suitable, the reaction liquid containing calcium nitrate can be discharged onto the paper-based recording medium S by the reaction liquid discharge unit 31, whereas, when recording is performed on the film-based recording medium S for which the reaction liquid containing calcium acetate is suitable, the reaction liquid containing calcium acetate can be discharged onto the film-based recording medium S by the reaction liquid discharge unit 31. Accordingly, it is possible to use a suitable reaction liquid to be discharged onto the recording medium S in accordance with the type of recording medium S.

According to the second embodiment, the type of recording medium S detected by the detection unit 48 is input to the input unit 35, and the valve drive unit 39 drives switching of the flow path switching valve 46 on the basis of the input result. However, as in the first embodiment, the type of recording medium S may be input to the input unit 35 in accordance with an operator's operation of the operation unit 30, and the valve drive unit 39 may drive switching of the flow path switching valve 46 on the basis of the input result. In addition, the operator may manually drive switching of the flow path switching valve 46. Further, even in the first embodiment, the type of recording medium S detected by the detection unit 48 may be input to the input unit 35, and the first reaction liquid discharge unit 31*a* and the second reaction liquid discharge unit 31*b* are selectively driven to perform discharging on the basis of the input result.

In the recording apparatus 1 according to the first embodiment and the recording apparatus 100 according to the second embodiment, as an example, the reaction liquid discharge section that applies the reaction liquid on the recording medium S discharges the reaction liquid in an ink jet method. However, the reaction liquid discharge section is not limited thereto. For example, the reaction liquid discharge section may discharge the reaction liquid in a spray form toward the recording medium S from a spray head. In addition, the reaction liquid applying mechanism 3 is not limited to discharging the reaction liquid, but may apply the reaction liquid on the recording medium S using an applying roller.

In the recording apparatus 1 according to the first embodiment and the recording apparatus 100 according to the second embodiment, the two types of reaction liquids are suitably used, but three types or more of reaction liquid may be suitably used.

According to the first embodiment and the second embodiment, the application of the invention to the drum transport type recording medium 1 is described, but the application is not limited thereto. As shown in FIG. 5, the invention can be applied to a flat-transport type recording apparatus 200 as well. The recording apparatus 200 according to a third embodiment includes a reaction liquid spraying section 210 that sprays the reaction liquid onto the recording medium S, a carriage unit 211 having multiple recording heads 212 configured to have ink jet heads, an X-axis table 213 that moves the carriage unit 211 in an X-axis direction which is a transport direction of the recording medium S, a Y-axis table (not shown) that is mounted on the X-axis table 213 and minutely moves the carriage unit 211 in a Y-axis direction, a platen 215 disposed on a base plate 203 to face the carriage unit 211, and a paper transport mechanism 216 that feeds the recording medium S from a supply unit 206 to the platen 215 and sends the recording medium from the platen 215 to a winding unit 207. The reaction liquid spraying section 210 includes a first spray head 221 that discharges the first reaction liquid in a spray form onto the recording medium S, a second spray head 222 that discharges the second reaction liquid in a spray form onto the recording medium S, and a spray drive unit 223 that selectively drives either the first spray head 221 or the second spray head 222.

The spray drive unit 223 is an example of "selection drive section" in the claims of the invention.

REFERENCE SIGNS LIST

1 Recording apparatus (first embodiment)
3 Reaction liquid applying mechanism
5 Ink discharge mechanism
S Recording medium
100 Recording apparatus (second embodiment)
200 Recording apparatus (third embodiment)

The invention claimed is:

1. A recording apparatus comprising:
a discharge drive section;
a transport mechanism that transports a recording medium;
a reaction liquid applying mechanism that selectively applies, on the recording medium, either a first reaction liquid that reacts with ink or a second reaction liquid that reacts with the ink and is different from the first reaction liquid; and
an ink discharge mechanism that is positioned downstream from the reaction liquid applying mechanism in the transport direction of the recording medium and discharges the ink onto the recording medium,
wherein a deliquescent of the first reaction liquid is higher than the deliquescent of the second reaction liquid and a pungent odor of the second reaction liquid is higher than the pungent odor of the first reaction liquid, and
wherein the discharge drive section drives the reaction liquid applying mechanism to apply the first reaction liquid on the recording medium when the type of the recording medium is paper-based and to apply the second reaction liquid on the recording medium when the type of the recording medium is film-based.

2. The recording apparatus according to claim 1, wherein the reaction liquid applying mechanism includes a reaction liquid discharge section that selectively discharges either the first reaction liquid or the second reaction liquid, onto a certain position of the recording medium.

3. The recording apparatus according to claim 2, wherein the reaction liquid discharge section includes:
a first reaction liquid discharge unit that discharges the first reaction liquid; and
a second reaction liquid discharge unit that discharges the second reaction liquid.

4. The recording apparatus according to claim 2, wherein the reaction liquid applying mechanism further includes:
a first reaction liquid container in which the first reaction liquid is contained;
a second reaction liquid container in which the second reaction liquid is contained; and
a switching unit that performs switching between a first state, where the first reaction liquid is supplied from the first reaction liquid container to the reaction liquid discharge section, and a second state, where the second reaction liquid is supplied from the second reaction liquid container to the reaction liquid discharge section.

5. The recording apparatus according to claim 1, wherein the first and second reaction liquids each contain a coagulant to react with the ink, thereby promoting fixing of the ink on the recording medium.

6. The recording apparatus according to claim 1, further comprising:
an input unit to which the type of recording medium is input,
wherein the discharge drive section drives the reaction liquid applying mechanism selectively applies either the first reaction liquid or the second reaction liquid, on the basis of a result of input to the input unit.

7. The recording apparatus according to claim 6, wherein the type of recording medium is input to the input unit by an operator.

8. The recording apparatus according to claim 6, further comprising:
a detection unit that detects the type of recording medium,
wherein the type of recording medium detected by the detection unit is input to the input unit.

* * * * *